United States Patent [19]

Takahashi et al.

[11] 3,981,730

[45] Sept. 21, 1976

[54] DIAZO-TYPE MULTICOLOR REPRODUCTION PROCESS

[75] Inventors: Kenzi Takahashi; Toshihiro Kouchi, both of Hirakata; Yasutoki Kamezawa, Tsuzuki; Tatsuo Aizawa, Osaka, all of Japan

[73] Assignee: Mita Industrial Company, Ltd., Osaka, Japan

[22] Filed: Apr. 16, 1974

[21] Appl. No.: 461,444

[30] Foreign Application Priority Data

Apr. 18, 1973 Japan ..... 48-43050
Apr. 18, 1973 Japan ..... 48-43051

[52] U.S. Cl. ..... 96/49; 96/75; 96/91 R; 106/19; 106/27; 250/317; 250/318; 427/261

[51] Int. Cl.[2] ..... G03C 5/34

[58] Field of Search ..... 96/49, 75, 91 R; 250/317, 318; 427/261

[56] References Cited

UNITED STATES PATENTS

| | | | |
|---|---|---|---|
| 2,691,587 | 10/1954 | Greig | 96/49 |
| 2,789,904 | 4/1957 | Benbrook et al. | 96/49 |
| 2,807,545 | 9/1957 | Frederick | 96/91 R |
| 2,969,015 | 1/1961 | Klimkowski et al. | 96/49 |
| 3,248,220 | 4/1966 | Van Rhijn | 96/49 |
| 3,255,007 | 6/1966 | Kosar | 96/49 |
| 3,454,764 | 7/1969 | Collier et al. | 96/49 |
| 3,715,213 | 2/1973 | Nihyakumen et al. | 96/91 R |
| 3,809,560 | 5/1974 | Neuman | 96/49 |
| 3,820,996 | 6/1974 | Nihyakumen et al. | 96/49 |
| 3,907,567 | 9/1975 | Nihyakumen et al. | 96/49 |

FOREIGN PATENTS OR APPLICATIONS

| | | | |
|---|---|---|---|
| 815,005 | 6/1959 | United Kingdom | 96/75 |
| 1,000,151 | 8/1965 | United Kingdom | 96/49 |
| 1,169,745 | 11/1969 | United Kingdom | 96/49 |

*Primary Examiner*—Charles L. Bowers, Jr.
*Attorney, Agent, or Firm*—Wenderoth, Lind & Ponack

[57] ABSTRACT

An improved process for the diazo-type multicolor reproduction which can give multicolored copies excellent in the hue separation and can increase the number of copies obtained from an original treated with a color-forming agent is disclosed. This improved multicolor reproduction process is characterized by the use of a color-forming composition comprising a thermovolatile or sublimable coupler and at least one hue separation-improving agent selected from polyalkylene oxides and polyalkylene oxide derivatives which are solid under normal conditions and fatty acid derivatives having a melting point of at least 100°C.

17 Claims, No Drawings

DIAZO-TYPE MULTICOLOR REPRODUCTION PROCESS

This invention relates to a diazo-type multicolor reproduction process and to a diazo-type color-forming composition for use in this process. More particularly, the invention relates to a color-forming composition for the diazo-type reproduction, which is used for forming a diazo-type multicolored image by heat-transferring a coupler to a pre-selected area of a diazo-type photosensitive material in correspondence with a pre-selected area of an original to be reproduced in a hue different from the hue of other area and coupling the heat-transferred coupler with a diazonium salt, and to a diazo-type multicolor reproduction process using this color-forming composition.

We previously proposed a diazo-type multicolor reproduction process which comprises conducting the steps of (A) exposing to light a diazo-type photosensitive material containing at least one diazonium salt and (B) bringing a layer of at least one thermovolatile or sublimable coupler (a) into face-to-face contact with the diazo-type photosensitive material at an area corresponding with a pre-selected area of an original and heating the assembly to effect the heat transfer of the coupler, said steps being conducted simultaneously or successively in an order of (A) to (B) or (B) to (A), and developing the exposed photosensitive material in the presence of a coupler (b) having a lower coupling rate than the coupler (a) under the conditions of development, to thereby obtain a diazo-type multicolored copy in which the area of the photosensitive material corresponding with the pre-selected area of the original is colored in a hue different from the hue of other area of the photosensitive material (see U.S. Pat. No. 3,715,213).

In this diazo-type multicolor reproduction process, an original for the diazo-type multicolor reproduction is formed by applying a thermo-volatile or sublimable coupler to a pre-selected area of the surface, to be faced to a diazo-type photosensitive material, of a transparent or semi-transparent original, namely a pre-slected area to be reproduced in a different hue. This heat-transferable coupler is applied to the pre-selected area of the surface of the original in the form of a liquid or waxy color-forming composition.

Heretofore proposed color-forming compositions, however, are still insufficient in respect to adhesion to the original surface and control of the amount of the coupler to be heat-transferred. For instance, when such liquid or waxy color-forming composition is applied to a second original comprising as a base a coated paper or plastic film, which is preferably employed as a base of a second original for diazo-type reproduction because it has good durability and high transparency, since the adhesive property of the liquid or waxy composition to the surface of such original is poor, it separates from the original surface quite readily under slight friction, and it is frequently difficult to obtain a prescribed number of copies.

Further, in the above-mentioned process of our previous proposal, it is difficult to control the amount of the thermovolatile or sublimable coupler heat-transferred to the diazo-type photosensitive layer by one printing operation, to a small amount within a range capable of giving a sufficient hue separation.

More specifically, when conventional color-forming compositions are used for formation of originals for multicolor reproduction, at the initial stage of the continuous reproduction operation a large quantity of the thermo-volatile on sublimable coupler is transferred, and it is generally difficult to obtain more than 10 copies in which sufficient hue separation is accomplished.

As a result of our research work made on semi-solid or solid vehicles to be incorporated into the above-mentioned color-forming compositions for diazo-type reproduction, it has been found that when at least one hue separation-improving agent selected from the group consisting of polyalkylene oxides and polyalkylene oxide derivatives which are solid under normal conditions and fatty acid derivatives having a melting point of at least 100°C. is incorporated into such vehicle, the applied color-forming composition can be tightly bonded and retained on the original surface, the amount of the coupler heat-transferred by one printing operation can be controlled to a relatively small level within a range capable of attaining sufficient color formation between the coupler and diazonium salt and hence, it is made possible to obtain a great number of copies in which good hue separation is attained.

It has also been found that the above-mentioned polyalkylene oxides and polyalkylene oxide derivatives which are solid under normal conditions and fatty acid derivtives having a melting point of at least 100°C. have an effect of promoting the selective coupling between the heat-transferred coupler and diazonium salt in the photosensitive layer and when a color-forming composition incorporated with such hue separation-improving agent is used for the diazo-type multicolor reproduction, the hue separation is highly improved in obtained copies.

This invention relates to the improvement in a process for diazo-type multicolor reproduction which comprises conducting the steps of (A) exposing to light a diazo-type photosensitive material through a transparent or semi-transparent original having a color-forming layer containing a thermo-volatile or sublimable coupler (a) at a pre-selected image area to be reproduced in a different hue on the surface to be faced to a photosensitive layer of the diazo-type photosensitive material and (B) heating the assembly in such a state that the color-forming layer has a face-to-face contact with the diazo-type photosensitive layer, to thereby transfer the thermo-volatile or sublimable coupler (a) to the diazo-type photosensitive layer, said steps (A) and (B) being conducted simultaneously or successively in an order of (A) to (B) or (B) to (A), and developing the coupler-transferred and light-exposed photosensitive material in the presence of a coupler (b) having a lower coupling rate than the coupler (a) under the conditions of development, to thereby obtain a diazo-type multicolored copy in which a preselected area of the photosensitive material which corresponds with the pre-selected area of the original is reproduced in a hue different from the hue of other area of the photosensitive material, the improvement being characterized in that in addition to the thermovolatile or sublimable coupler (a), the color-forming layer contains at least one hue separation-improving agent selected from the group consisting of polyalkylene oxides and polyalkylene oxide derivatives which are solid under normal conditions and fatty acid derivatives having a melting point of at least 100°C.

According to this invention, there is further provided a color-forming composition for heat-transferring a coupler to a diazo-type photosensitive layer in the diazo-type multicolor reproduction, which comprises a thermo-volatile or sublimable coupler and at least one hue separation-improving agent selected from the group consisting of polyalkylene oxides and polyalkylene oxide derivatives which are solid under normal conditions and fatty acid derivatives having a melting point of at least 100°C.

As the thermo-volatile or sublimable coupler (a), there can be used known couplers which are free of thermally decomposable groups such as carboxylic and sulfonic acid groups or their salt groups. Suitable examples of the coupler (a) are illustrated in the specification of the above-mentioned U.S. Pat. No. 3,715,213. In this invention, it is preferred to used couplers which have a good compatibility with a solid vehicle incorporated with a polyalkylene oxide or its derivative or a fatty acid derivative and have a relatively high chemical stability to heat. Preferred couplers having such properties are mentioned below.

Phenol Derivatives resorcin, pyrogallol, 4-chlororesorcin and 4-bromoresorcin

Aniline Derivatives m-aminophenol, o-aminophenol and dimethyl-m-aminophenol

Naphthol Derivatives $\beta$-naphthol, $\alpha$-naphthol, 2,3-dihydroxynaphthalene, 2,7-dihydroxynaphthalene, 1,7-dihydroxynaphthalene and 1,6-dihydroxynaphthalene Active Methylene-Containing Compounds 1-phenyl-3-methylpyrazolone(5), 1-(3'-chlorophenyl)-3-methylpyrazolone(5), 1-(p-toluyl)-3-methylpyrazolone(5) and acetoacetic anilide These couplers can be used singly or in the form of admixtures of two or more of them.

As the polyalkylene oxide being solid under normal conditions, there are employed, for example, polyalkylene oxides having recurring units represented by the following formula $$\text{-}(RO)_n\text{-}$$

wherein R is an alkylene group having 2 to 4 carbon atoms, and n is a number so selected that the polymer is solid under normal conditions.

These polyalkylene oxides may be homopolymers or block or graft copolymers. Preferred examples of such polyalkylene oxide include polyethylene oxide, polypropylene oxide, polyethylene oxide-polypropylene oxide block copolymers and polyethylene oxide-polypropylene oxide graft copolymers.

In these polyalkylene oxides, the molecular weight is so selected that they are solid under normal conditions (20°C. and 1 atmosphere). In the case of polyethylene oxide, for example, if the molecular weight is lower than 400, the polymer is liquid under normal conditions and if the molecular weight is higher than 3000, the polymer is solid under normal conditions, which a polymer having an intermediate molecular weight takes a semi-solid or soft waxy form. Therefore, it is preferred in the case of polyethylene oxide to employ polymers having a molecular weight of at least 3000, especially at least 9000. Polypropylene oxides prepared by anionic polymerization using an alkali catalyst, cationic polymerization using an acidic catalyst or Lewis acid catalyst and by stereospecific polymerization using a rearrangement catalyst are known in the art. In this invention, all of these polypropylene oxides can be used as far as they have a molecular weight of at least 1000. It is especially preferred in this invention to employ stereospecific polypropylene oxides having a molecular weight of at least 1000. It is known that a variety of polyethylene oxide-polypropylene oxide block copolymers which are solid under normal conditions can be prepared by adjusting the molecular weight or the polyethylene oxide content. Any of these block copolymers can be used in this invention.

As the polyalkylene oxide derivative being solid under normal conditions, there can be employed any of adducts formed between an alkylene oxide and an active hydrogen-containing compound such as carboxylic acids, alcohols, phenols, amines and amides, as far as it is solid under normal conditions. Preferred examples of such polyalkylene oxide derivative are as follows.

a. Carboxylic Acid Esters:

Esters represented by the formula $R'COO(RO)_nH$ or $R'COO(RO)_nCOR'$ in which R stands for an alkylene group having 2 to 4 carbon atoms, R' is a higher aliphatic hydrocarbon group, especially an alkyl group having at least 12 carbon atoms, and $n$ is a number larger than 1, such as mono- and di-esters of polyethylene glycol with stearic acid, and mono- and di-esters of polypropylene glycol with stearic acid.

b. Ethers:

Ethers represented by the formula $R^2O(RO)_nH$ or $R^2O(RO)_nR^2$ in which R is as defined above, $R^2$ stands for a hydrocarbon group having at least 6 carbon atoms, especially a higher alkyl or alkylphenyl group, and n is as defined above, such as stearyl polyethylene glycol mono- and di-ethers, stearyl polypropylene glycol mono- and di-ethers and t-butylphenyl polyethylene glycol mono- and di-ethers; and addition polymers of ethylene oxide or propylene oxide and a polyhydric alcohol having at least 3 alcoholic hydroxyl groups, such as sorbitol, glycerin and pentaerythritol.

c. Amines:

Amines represented by the formula

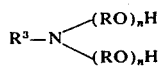

in which R and n are as defined above and $R^3$ stands for a hydrocarbon group, especially an aliphtatic hydrocarbon group or aryl group having at least 6 carbon atoms, such as adducts of oleyl amine or stearyl amine and ethylene oxide or propylene oxide and adducts of aniline to ethylene oxide; and adducts of 5- or 6-membered saturated heterocyclic amino compounds such as pyrrolidine, piperidine, piperazine and morpholine, polyethylene imines or other polyamines and ethylene oxide or propylene oxide.

d. Amides:

Amides represented by the formula

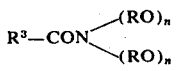

in which R, $R^3$ and n are as defined above, such as ethylene oxide or propylene oxide adducts of stearic acid amide, lauric acid amide or oleic acid amide; and ethylene oxide or propylene oxide adducts of amide resins, lactams or the like.

As the fatty acid derivative having a melting point of at least 100°C., there can be employed any of fatty acid derivatives other than the above-mentioned fatty acid polyalkylene oxide esters, such as fatty acid amides, fatty acid imides, fatty acid aminoalkyl esters, fatty acid salts (metal soaps) and fatty acid amideformaldehyde condensates, as far as the melting point is 100°C. or higher.

In this invention there are generally employed derivatives of saturated or unsaturated fatty acids having at least 10 carbon atoms, such as undecanoic acid, lauric acid, tridecanoic acid, myristic acid, pentadecanoic acid, palmitic acid, margaric acid, stearic acid, nonadecanoic acid, arachic acid, behenic acid, lignoceric acid, cerotic acid, linderic acid, lauroleic acid, myristoleic acid, zoomaric acid, petroceric acid, oleic acid, elaidic acid, linoleic acid, eleostearic acid, linolenic acid, and mixtures of two or more of these fatty acids. Preferred examples of the fatty acid derivative to be used in this invention are as follows.

Amides lauric acid amide, myristic acid amide, palmitic acid amide, stearic acid amide, arachic acid amide, behenic acid amide, ethylene-bis-stearic acid amide and ethylene-bis-palmitic acid amide Hydrazides palmitic acid hydrazide and stearic acid hydrazide p-Hydroxyanilides myristic acid-p-hydroxyanilide and stearic acid-p-hydroxyanilide β-Diethylaminoethyl Ester Hydrochlorides lauric acid-β-diethylaminoethyl ester hydrochloride and stearic acid-β-diethylaminoethyl ester hydrochloride Fatty Acid Salts zinc stearate, aluminum stearate, magnesium stearate, calcium stearate and potassium oleate Fatty Acid Amide-Formaldehyde Condensates stearic acid amide-formaldehyde condensate, plamitic acid amide-formaldehyde condensate and formaldehyde condensate with mixed fatty acid amide (stearic acid amide : palmitic acid amide = 7 : 3)

In this invention, the foregoing polyalkylene oxides, polyalkylene oxide derivatives and fatty acid derivatives can be used singly or in the form of mixtures of two or more of them. Further, such hue separation-improving agent can be used singly or in combination with other solid vehicle such as wax.

When the above-mentioned hue separation-improving agent is incorporated singly or in combination with other solid vehicle into a color-forming composition for coupler transfer according to this invention, prominent advantages are attained over the case where such a vehicle as a fatty acid or wax alone is incorporated into a color-forming composition.

For example, a fatty acid is excellent in the adherence or retention on the original surface, but it is very poor in the property of retaining or gradually releasing a thermo-volatile or sublimable coupler. Accordingly, if it is desired to obtain copies excellent in the color reproduction from an original treated with a color-forming composition containing a fatty acid, only several sheets of sufficient copies are obtained. Further, most of fatty acids have a melting point lower than 90°C. and fatty acids having a melting point higher than 90°C. are poor in the adherence or retention on the original surface. Likewise, most of mineral, vegetable and animal waxes are insufficient in the adherence or retention on the original surface, and waxes having an excellent adherence or retention on the original surface are insufficient in the property of retaining or gradually releasing a thermo-volatile or sublimable coupler. Accordingly, if it is intended to obtain copies excellent in the color reproduction from an original treated with a color-forming composition containing such wax, there are obtained only several copies.

Although fatty acid derivative to be used in this invention have such a high melting point as 100°C. or higher, they as well as polyalkylene oxides and polyalkylene oxide derivatives which are solid under normal conditions can be retained in a good sticking condition even on the surface of an inactive base such as a coated paper or plastic film when they are applied thereon singly or in combination with other solid vehicle, and these hue separation-improving agents of this invention have such a desired property that upon heating they gradually release a thermo-volatile or sublimable coupler from the color-forming composition layer. Still further, they exhibit a novel and unexpected effect of promoting selectively the coupling reaction between the heat-transferred coupler and diazonium salt contained in the photosensitive layer. The reason why they exhibit such peculiar effect has not been elucidated completely, but it is believed that these hue separation-improving agents of this invention have surface active and lubricating effects and promote approach and dispersion of the coupler to the diazonium salt at the heat transfer or development step.

In this invention, the thermo-volatile or sublimable coupler and the hue separation-improving agent can be used at various mixing ratios. For example, the hue separation-improving agent is used in an amount of 20 to 250 parts by weight, preferably 50 to 200 parts by weight, per 100 parts by weight of the thermo-volatile or sublimable coupler, and their mixing ratio is chosen within this range so that a good combination of the adherence on the original surface and the property of gradually releasing the coupler can be obtained.

In this invention, it is sometimes preferred to employ a mixture of (i) a polyalkylene oxide or polyalkylene oxide derivative being solid under normal conditions and (ii) a fatty acid derivative having a melting point of at least 100°C., in order to further improve the hue separation. In this case, it is desired that the polyalkylene oxide or polyalkylene oxide derivative (i) and the fatty acid derivative (ii) are used at a mixing weight ratio ranging from 1 : 10 to 1 : 2.

In the color-forming composition of this invention, various additives can be used depending on the intended use. For example, in one embodiment of this invention the hue separation-improving agent, especially the polyalkylene oxide or its derivative, is used in combination with a molding agent such as a wax. The solid vehicle to be used as the molding agent in this invention includes the following substances.

Mineral Waxes:

1. Petroleum waxes such as paraffin wax, microcrystalline wax and petrolatum

2. Solid bitumens such as ozocerite, ceresine and montan wax

Vegetable Waxes:

Carnauba wax, cotton wax, haze wax and palm wax

Animal Waxes:

Bees wax and wool wax

Solid Fatty Acids and Their Derivatives:

Stearic acid, palmitic acid, lauric acid, lauryl amide and calcium laurate

Fats:

Hardened castor oil and hardened beef tallow oil

Solid Alcohols:

Stearyl alcohol, palmityl alcohol and lauryl alcohol

The fatty acid derivative to be used as the hue separation-improving agent in this invention has an activity as the molding agent. Therefore, if the fatty acid derivative is incorporated into the color-forming composition of this invention, use of a particular molding agent is not always indispensable.

In case a molding agent such as exemplified above is employed, it is preferred that the molding agent is incorporated in such an amount that the amount of the polyalkylene oxide or its derivative is at least 5 parts by weight, especially 10 to 30 parts by weight, per 100 parts by weight of the molding agent.

In this invention, in order to impart good form-retaining and graphic properties to the color-forming composition, it is possible to incorporate an inorganic solid powder. As such inorganic powder acting as extender pigment, there can be employed, for example, finely divided silica (colloidal silica), a variety of clays and activated clays. Further, if it is desired to improve the heat transferability of the thermo-volatile or sublimable coupler, it is possible to incorporate as a heat transfer promotor a solid sublimable organic compound such as naphthalene or its derivatives, terpenes. e.g., camphor, menthold and camphene, halogenated benzenes, e.g., p-dichlorobenzene, and the like. Still further, in the color-forming composition of this invention, it is possible to incorporate as an extender starch, dextrin, carboxymethyl cellulose or the like. Still in addition, a color pigment or dye can be incorporated into the color-forming composition in order to indicate clearly the portion coated or treated with the color-forming composition, so far as the light transmission is not substantially damaged.

Examples of preferred color-forming compositions of this invention are as follows (all percentages and parts given hereinafter are by weight unless otherwise indicated): Solid Color-Forming Compositions:

| | |
|---|---|
| Thermo-volatile or sublimable coupler | 10 – 80 parts |
| Hue separation-improving agent | 5 – 70 parts |
| Molding agent | 0 – 60 parts |
| Extender pigment | 0 – 50 parts |
| Heat transfer-promoting agent | 0 – 20 parts |
| Extender | 0 – 30 parts |
| Colorant | 0 – 2 parts |

In the foregoing compositions, it is preferred that the polyalkylene oxide or its derivative is used in an amount of 5 to 30 parts in combination with 10 to 60 parts of the molding agent and that the fatty acid derivative is used in an amount of 10 to 70 parts.

The color-forming composition of this invention can be shaped into a crayon, stick, chalk-like form or a color pencil with such a sheath as wood, paper or plastics by mixing the composition homogeneously, melting it under heating, shaping it into a desired form by melt extrusion or other suitable molding means and cooling and solidifying it.

It is also possible to shape the color-forming composition of this invention into a crayon or pencil by dispersing the composition into an aliphatic alcohol such as methanol, ethanol, isopropanol and isobutyl alcohol, an aromatic organic solvent such as benzene, toluene and xylene, an ester or a neutral liquid containing a hydroxyl group such as water, n-hexyl alcohol, n-heptyl alcohol and 3-heptanol, and solidifying the dispersion by vaporizing the solvent thereform.

Further, a pressure-sensitive transfer sheet having a layer of the solid color-forming composition of this invention can be prepared by coating the composition in the state mixed or dissolved in a mineral oil or a non-volatile oil such as drying and semi-drying oils on tissue paper, coated tissue paper or plastic film.

In case diazo-type reproduction is conducted with use of the color-forming composition of this invention, the composition is applied to the surface, to be faced to the diazo-type photosensitive layer, of the original (hereinafter referred to as "the transfer surface"). In this case, the composition can be applied to the transfer surface at either the entire image area or a pre-selected portion of the image area. Further, it is possible to treat the transfer surface of the original with one color-forming composition at one pre-selected image area and with another color-forming composition at another pre-selected image area. In this case, diazo-type multicolored copies can be obtained.

Application of the color-forming composition to the transfer surface of the original is accomplished by writing on the transfer surface of the original with the above-mentioned crayon or pencil or by combining the original and a pressure-sensitive transfer paper coated with the color-forming composition so that the transfer surface of the original is brought into face-to-face contact with the coated surface of the pressure-sensitive transfer sheet and writing on the transfer surface of the original with a stencil pen or the like. In the latter case, the image area of the original need not be precisely in agreement with the color-forming composition-coated layer, and no particular disadvantage is brought about even if the coated layer protrudes from the image area of the original.

The color-forming composition-applied original and a diazo-type photosensitive material are combined so that the photosensitive layer of the photosensitive material is brought into face-to-face contact with the coupler-applied surface of the original, and the assembly is light-exposed and heated simultaneously or successively in this order or in a reverse order, whereby the heat-transferable coupler is transferred from the transfer surface of the original to the diazo-type photosensitive layer and photo-decomposition of the diazonium salt in the photosensitive layer occurs in correspondence with the light transmission of the image of the original. When the thus light-exposed and coupler-transferred diazo-type photosensitive material is developed according to a known developement method, the undecomposed diazonium salt left in correspondence with the image of the original is coupled with the heat-transferred coupler to form a dye image. When a pre-selected portion of the image area of the transfer surface of the original is treated with the color-forming composition and development is conducted in the presence of a coupler (b) of a principle color which is colored, on coupling with the diazonium salt, in a hue different from the color hue of the coupler (a) contained in the color-forming composition, the undecomposed diazonium salt is coupled with the principle color coupler (b) in areas where no heat-transferred coupler (a) is present and a multicolored copy having hues different from each other can be obtained.

The color-forming composition of this invention has good adherence and retention on the transfer surface of the original even when the transfer surface of the original is a plastic film surface or coated surface which is poor in its adhesion characteristics. Further, in the case of the color-forming composition of this invention, the amount of the coupler transferred by one printing operation is controlled to an optimum value. Therefore, the original treated with the color-forming composition of this invention can be reproduced repeatedly more than 20 times. Even when a two-component type diazo-type photosensitive material is employed, the polyalkylene oxide or its derivative or the fatty acid derivative contained in the color-forming composition promotes the selective coupling between the heat-transferred coupler and diazonium salt and therefore, diazo-type multicolored copies excellent in the hue separation can be obtained.

A photosensitive material containing a diazonium salt is chosen appropriately depending on the development method. In general, there is preferably a photosensitive material formed by coating a photosensitive composition containing a diazonium salt and, if necessary, a coupler (b) having a lower coupling rate than the thermo-volatile or sublimable coupler (a), on a substrate such as paper, plastic film, fiber fabric, non-woven fabric, metal foil and the like.

Examples of the photosensitive composition are as follows:

1. Two-component type diazo-type photosensitive composition:

| | |
|---|---|
| Diazonium compound | 0.2 – 5.0 % |
| Coupler (b) | 0.2 – 5.0 % |
| Organic acid | 1.0 – 10.0 % |
| Development promotor | 0.5 – 10.0 % |
| Extender | 0 – 5.0 % |
| Colorant | 0.001 – 0.025 % |
| Solvent | balance |

The above photosensitive composition is coated and dried on a substrate such as paper, plastic film or the like to form a photosensitive sheet.

2. One-component type diazo-type photosensitive composition:

| | |
|---|---|
| Diazonium compound | 0.2 – 5.0 % |
| Organic acid | 0.1 – 5.0 % |
| Extender | 0 – 2.5 % |
| Solvent | balance |

The above photosensitive composition is coated and dried on a substrate such as paper, plastic film or the like to form a photosensitive sheet.

Any of the diazonium compounds capable of coupling with the thermo-volatile or sublimable coupler (a) and an ordinary coupler (b) under ordinary conditions of development can be used as the diazonium compound. Preferred diazonium compounds are illustrated in the specification of the above-mentioned U.S. Pat. No. 3,715,213.

Any of azo-coupling components (couplers) capable of coupling with a diazonium salt under ordinary conditions of the development can be used as the coupler (b) in the above photosensitive composition. Also preferred examples of such coupler are illustrated in the specification of the above-mentioned U.S. Pat. No. 3,715,213.

The exposure of the photosensitive material and the heat transfer of the diazo-type color-forming composition to the photosensitive layer surface of the photosensitive material can be performed simultaneously. For instance, when a mercury lamp is used as a light source for the exposure, by heat transferred from a cylinder glass of the light source heated at a relatively high temperature, the heat transfer of the thermo-volatile or sublimable coupler (a) can be accomplished simultaneously with the exposure. Of course, it is possible to perform the heat transfer of the thermo-volatile or sublimable coupler (a) by radiation heating of the original image. The conditions for the heat transfer of the coupler (a) are varied depending on the kind of the coupler and the heating time, but it is generally preferred that the coupler layer is heated at a temperature higher than 50°C., especially 60° to 100°C.

It is possible to combine an original treated with the color-forming composition and a photosensitive material, pass the assembly through a heating roller or infrared radiation zone to heat the coupler layer at a temperature within the above range and effect the heat transfer of the coupler, and then to pass the heated assembly through a light exposure zone to light expose the photosensitive material.

Alternatively, the assembly of the original for multicolor reproduction and the photosensitive material may first be passed through an exposure zone and then may be passed through a heating zone, whereby the light exposure of the photosensitive material and the heat transfer of the coupler can be accomplished.

The exposed photosensitive material in which the thermo-volatile or sublimable coupler has been transferred on the entire portion or only on a pre-selected portion is developed by known development means in the presence of a coupler (b) having a lower coupling rate than the thermo-volatile or sublimable coupler (a) or in the absence of such coupler (b) when it has been incorporated in advance in the photosensitive layer. In other words, the coupler (b) may have been incorporated in the photosensitive layer in advance or may be incorporated in the developer. The development may be achieved by any of the wet, dry and heat development methods. In case a coupler-containing photosensitive material is employed, if prior to development the photosensitive material containing the diazonium salt and heat-transferred coupler is pre-treated with an affinity-imparting treating liquid comprising one or more of aliphatic alcohols, aromatic organic solvents, esters, glycols and hydroxyl group-containing liquids having a boiling point of 100° to 200°C., such as water and high-boiling-point alcohols, uniform contact can be attained between the heat-transferred coupler and undecomposed remaining diazonium salt. In this invention, such pre-treatment need not be performed generally. In the case of a two-component type diazo-type photosensitive paper, development can be achieved by exposing the light-exposed and coupler-transferred photosensitive material to a gaseous mixture of ammonia and steam. In the case of a one-component type diazo-type photosensitive paper, the development can be achieved by coating a liquid developer having, for instance, the following composition:

| | |
|---|---|
| Coupler | 0.2 – 5 % |
| Alkali | 0.5 – 10 % |
| Reducing agent | 0 – 20 % |
| Surface active agent | 0 – 0.5 % |
| Water | balance |

on the photosensitive material by dipping, roller coating or spraying. Alternatively, the photosensitive material is exposed to a gaseous mixture of ammonia and steam in the same manner as described above or is contacted with an aqueous solution of an alkali free of a coupler, in order to achieve the development.

In the case of heat development, volatile organic acid and organic base are incorporated into the above-mentioned two-component type diazo-type photosensitive composition according to known recipes, and on development the diazonium compound-containing photosensitive layer is heated at a temperature ranging from 120° to 200°C.

Thus, according to this invention, the transfer of the thermo-volatile or sublimable coupler and the development of the diazo-type photosensitive layer can be performed simultaneously or successively in this order or a reverse order.

The color-forming composition of this invention for diazo-type reproduction is very advantageous for obtaining diazo-type colored copies, especially multicolored copies of charts, plans for construction working, plans for constructing of buildings or the like, plans for various machines, plans for ship building, electric circuit diagrams and other various diagrams or plans for industrial use. According to the reproduction process of this invention, important or significant portions of originals such as the above-mentioned charts, plans and diagrams can be effectively reproduced in hues different from those of other portions, and a good separation can be attained between these different hues.

The following Examples illustrate the invention.

EXAMPLE 1

A composition of the following recipe is prepared as a red color-forming solid composition:

| | |
|---|---|
| 1-Phenyl-3-methylpyrazolone(5) | 40 g |
| Polyethylene glycol No. 20000 | 10 g |
| Palmitic acid | 25 g |
| Paraffin wax | 20 g |
| $SiO_2$ (Acrosil No. 200 manufactured by Nippon Acrosil K.K.) | 5 g |

The composition is heated and molten, and the melt is solidified and molded into a crayon, stick or color pencil to form a color-forming agent for treating the surface of an original to be brought into face-to-face contact with a photosensitive material, in areas to be reproduced in a different hue.

EXAMPLE 2

A solid composition to be used as a red color-forming agent is prepared by heating and melting the following components:

| | |
|---|---|
| 1-(3'-chlorophenyl)-3-methyl-pyrazolone | 50 g |
| Lauric acid amide | 30 g |
| Polyethylene glycol mono-ester 4 | |

-continued

| | |
|---|---|
| stearic acid | 8 g |
| Hi-Filler (talc manufactured by Matsumura Sangyo K.K.) | 12 g |

and solidifying the melt.

The solid composition is molded into a crayon, chalk or color pencil to be used as an agent for treating the surface, to be faced to a diazo-type photosensitive layer, of an original in an area to be reproduced in a different hue.

EXAMPLE 3

A solid composition to be used as a blue color-forming agent is prepared by heating and melting the following components:

| | |
|---|---|
| 2,3-Dihydroxynaphthalene | 40 g |
| Polypropylene glycol No. 10000 | 10 g |
| Activated clay | 15 g |
| Paraffin wax (melting point = 83°C.) | 35 g |

and solidifying the melt.

The solid composition is molded into a crayon, chalk or color pencil to be used as an agent for treating the surface, to be faced to a diazo-type photosensitive layer, of an original in an area to be reproduced in a different hue.

EXAMPLE 4

A solid composition to be used as a blue color-forming agent is prepared by heating and melting the following components:

| | |
|---|---|
| 1,6- (or 2,7-) Dihydroxynaphthalene | 50 g |
| t-Butylphenyl monoether of polyethylene glycol | 8 g |
| Stearic acid amide | 15 g |
| Haze wax | 12 g |
| Paraffin was | 10 g |
| Titanium oxide | 5 g |

and solidifying the melt.

The solid composition is molded into a crayon, chalk or color pencil to be used as an agent for treating the surface, to be faced to a diazo-type photosensitive layer, of an original in an area to be reproduced in a different hue.

EXAMPLE 5

A solid composition to be used as a violet color-forming agent is prepared by heating and melting the following components:

| | |
|---|---|
| 2,3-Dihydroxynaphthalene | 30 g |
| 1-Phenyl-3-methylpyrazolone(5) | 10 g |
| Lauric acid | 10 g |
| Stearic acid amide | 20 g |
| Polyethylene glycol No. 20000 | 10 g |
| Montan wax | 10 g |
| Hi-Filler (talc manufactured by Matsumura Sangyo K.K.) | 10 g |

and solidifying the melt.

The solid composition is molded into a crayon, chalk or color pencil to be used as an agent for treating the surface, to be faced to a diazo-type photosensitive layer, of an original in an area to be reproduced in a different hue.

EXAMPLE 6

A solid composition to be used as a yellow color-forming agent is prepared by heating and melting the following components:

| | |
|---|---|
| Acetoacetic anilide | 35 g |
| Polyethylene glycol No. 20000 | 15 g |
| Stearic acid | 30 g |
| Palm wax | 15 g |
| $SiO_2$ (Syloid 244 manufactured by Fuji Davison K.K.) | 5 g |

and solidifying the melt.

The solid composition is molded into a crayon, chalk or color pencil to be used as an agent for treating the surface, to be faced to a diazo-type photosensitive layer, of an original in an area to be reproduced in a different hue.

EXAMPLE 7

A solid composition to be used as a yellowish brown color-forming agent is prepared by heating and melting the following components:

| | |
|---|---|
| Resorcin | 40 g |
| Polyethylene glycol No. 6000 | 15 g |
| Palmitic acid amide | 20 g |
| Bees wax | 15 g |
| Magnesium oxide | 10 g |

The solid composition is molded into a crayon, chalk or color pencil to be used as an agent for treating the surface, to be faced to a diazo-type photosensitive layer, of an original in an area to be reproduced in a different hue.

EXAMPLE 8

A solid commposition to be used as a brown color-forming agent is prepared by heating and melting the following components:

| | |
|---|---|
| β-Naphthol | 35 g |
| Polypropylene glycol No. 10000 | 10 g |
| Ethylene-bis-stearic acid amide | 35 g |
| Paraffin wax | 15 g |
| Zinc oxide | 5 g |

and solidifying the melt.

The solid composition is molded into a crayon, stick or color pencil to be used as an agent for treating the surface, to be faced to a diazo-type photosensitive layer, of an original in an area to be reproduced in a different hue.

EXAMPLE 9

A solid brown color-forming agent is prepared by forming a solid composition in the same manner as in Example 8 except that pyrogallol is used instead of β-naphthol and molding the solid composition in the same manner as in Example 8.

EXAMPLE 10

20 g of a mineral oil is added to the color-forming composition of Example 1, and the mixture is kneaded in a ball mill with use of three heated rolls. Then, the kneaded mixture is coated on a substrate such as paper by means of a heated gravure roll coater, and is dried at a relatively low temperature (50° – 80°C.) to obtain a pressure-sensitive copy sheet. The so formed copy sheet is piled on the back surface of an original sheet and pressure is applied thereto by means of a typewriter or other writing means. There is thus formed a layer of the red color-forming composition on a part of the back surface of the original in an area to be reproduced in a different hue.

EXAMPLE 11

To the color-forming composition of Example 3 are added 20 g of hemp-seed oil and 5 g of Oil Blue, and the mixture is kneaded in a ball mill with use of three heated rolls. In the same manner as in Example 10, the kneaded mixture is formed into a pressure-sensitive copy sheet and is used to form a layer of the blue color-forming composition on the back surface of an original in the same manner as in Example 10.

EXAMPLE 12

Linseed oil is added to the color-forming composition of Example 6, and the mixture is formed into a pressure-sensitive copy sheet in the same manner as in Example 10. This pressure-sensitive copy sheet is used to form a layer of the yellow color-forming composition on the back surface of an original in the same manner as in Example 10.

EXAMPLE 13

20 g of flax oil is added to the color-forming composition of Example 8, and in the same manner as in Example 10 the mixture is formed into a pressure-sensitive copy sheet. The copy sheet is used to form a layer of the brown color-forming composition on the back surface of an original in the same manner as in Example 10.

EXAMPLE 14

A solid composition to be used as a red color-forming agent is prepared by heating and melting the following components:

| | |
|---|---|
| 1-Phenyl-3-methyl-pyrazolone(5) | 50 g |
| Palmitic acid amide | 30 g |
| Paraffin wax (melting point = 83°C.) | 15 g |
| Aerosil 200 (manufactured by Nippon Aerosil K.K.) | 5 % |

and solidifying the melt.

The solid composition is molded into a crayon, stick or color pencil to be used as an agent for treating the back surface of an original in an area to be reproduced in a different hue.

EXAMPLE 15

A solid composition to be used as a red color-forming agent is prepared by heating and melting the following components:

| | |
|---|---|
| 1-(3'-chlorophenyl-3-methyl-pyrazolone(5) | 50 g |
| Stearic acid p-hydroxyanilide | 23 g |
| Polyethylene glycol No. 6000 | 15 g |
| Hi-Filler (talc manufactured by Matsumura Sangyo K.K.) | 15 g |

and solidifying the melt.

The solid composition is molded into a crayon, chalk or color pencil to be used as an agent for treating the back surface of an original in an area to be reproduced in a different color.

EXAMPLE 16

A solid composition to be used as a blue color-forming agent is prepared by heating and melting the following components:

| | |
|---|---|
| 2,3-Dihydroxynaphthalene | 50 g |
| Stearic acid amide | 30 g |
| Activated clay | 10 g |
| Paraffin wax (melting point = 83°C.) | 10 g |

and solidifying the melt.

The solid composition is molded into a crayon, chalk or color pencil to be used as an agent for treating the back surface of an original in an area to be reproduced in an area to be reproduced in a different hue.

EXAMPLE 17

A solid composition to be used as a blue color-forming agent is prepared by heating and melting the following components:

| | |
|---|---|
| 1,6-(or 2,7-) Dihydroxynaphthalene | 50 g |
| Stearic acid amide-formaldehyde condensate | 25 g |
| Haze wax | 10 g |
| Paraffin wax (melting point = 83°C.) | 10 g |
| Titanium oxide | 5 g |

and solidifying the melt.

The solid composition is molded into a crayon, chalk or color pencil to be used as an agent for treating the back surface of an original in an area to be reproduced in a different hue.

EXAMPLE 18

A solid composition to be used as a violet color-forming agent is prepared by heating and melting the following components:

| | |
|---|---|
| 2,3-Hydroxynaphthalene | 30 g |
| 1-Phenyl-3-methyl-pyrazolone(5) | 10 g |
| Behenic acid amide | 10 g |
| Palmitic acid hydrazide | 20 g |
| Polyethylene glycol | 10 g |
| Hi-Filler (talc manufactured by Matsumura Sangyo K.K.) | 10 g |
| Montan wax | 10 g |

and solidifying the melt.

The solid composition is molded into a crayon, chalk or color pencil to be used as an agent for treating the back surface of an original to be reproduced in a different hue.

EXAMPLE 19

A solid composition to be used as a yellow color-forming agent is prepared by heating and melting the following components:

| | |
|---|---|
| Acetoacetic anilide | 50 g |
| Sodium stearate | 15 g |
| Palmitic acid bromoanilide | 15 g |
| Palm wax | 10 g |
| Olefin wax (melting point = 83°C.) | 5 g |
| Syloid 244 (manufactured by Fuji Davison K.K.) | 5 g |

and solidifying the melt.

The solid composition is molded into a crayon, chalk or color pencil to be used as an agent for testing the back surface of an original in an area to be reproduced in a different hue.

EXAMPLE 20

A solid composition to be used as a yellowish brown color-forming agent is prepared by heating and melting the following components:

| | |
|---|---|
| Resorcin | 50 g |
| Palmitic acid bromoanilide | 25 g |
| Bees wax | 10 g |
| Dextrin | 5 g |
| Polyethylene glycol | 10 g |
| Oil Yellow | 0.005 g |

and solidifying the melt.

The solid composition is molded into a crayon, chalk or color pencil to be used as an agent for treating the back surface of an original in an area to be reproduced in a different hue.

EXAMPLE 21

A solid composition to be used as a yellowish brown color-forming agent is prepared by heating and melting the following components:

| | |
|---|---|
| 4-Chlororesorcin | 50 g |
| Hydroxystearic acid amide-formaldehyde condensate | 30 g |
| Cotton wax | 10 g |
| Ethyl cellulose | 5 g |
| Hi-Filler | 5 g |

The solid composition is molded into a crayon, chalk or color pencil to be used as an agent for treating the back surface of an original in an area to be reproduced in a different hue.

EXAMPLE 22

A solid composition to be used as a brown color-forming agent is prepared by heating and melting the following components:

| | |
|---|---|
| β-Naphthol | 30 g |
| Ethylene-bis-stearic acid amide | 30 g |
| Polyethylene glycol 6000 | 10 g |
| Paraffin wax (melting point = 83°C.) | 5 g |
| Zinc oxide | 5 g |

and solidifying the melt.

The solid composition is molded into a crayon, chalk or color pencil to be used as an agent for treating one surface of an original in an area to be reproduced in a different hue.

EXAMPLE 23

A solid composition to be used as a brown color-forming agent is prepared by heating and melting the following components:

| | |
|---|---|
| Pyrogallol | 40 g |
| 1-Phenyl-3-methyl-pyrazolone(5) | 10 g |
| Hydroxystearic acid amide | 25 g |
| Paraffin wax | 10 g |
| Magnesium oxide | 5 g |

and solidifying the melt.

The solid composition is molded into a crayon, chalk or color pencil to be used as an agent for treating the back surface of an image of an original in an area to be reproduced in a different hue.

EXAMPLE 24

A solid composition to be used as a brown color-forming agent is prepared by heating and melting the following components:

| | |
|---|---|
| m-Aminophenol | 50 g |
| Stearic acid amide | 15 g |
| Hydrochloride of β-diethylamine ester of stearic acid | 15 g |
| Titanium oxide | 10 g |
| Polyethylene glycol No. 6000 | 10 g |

and solidifying the melt.

The solid composition is molded into a crayon, chalk or color pencil to be used as an agent for treating the back surface of an original to be reproduced in a different hue.

EXAMPLE 25

20 g of a mineral oil is added to the color-forming composition of Example 14, and the mixture is kneaded in a ball mill with use of three heated rolls. Then, the kneaded mixture is coated on a substrate such as paper by means of a heated gravure roll coater, and is dried at a relatively low temperature (50° – 80°C.) to obtain a pressure-sensitive copy sheet. The so formed copy sheet is placed on the back surface of an original sheet and pressure is applied thereto by means of a typewriter or other writing means. There is thus formed a layer of the red color-forming composition on a part of the back surface of the original in an area to be reproduced in a different he.

EXAMPLE 26

To the color-forming composition of Example 16 are added 20 g of flax oil and 5 g of Oil Blue, and the mixture is kneaded in a ball mill with use of three heated rolls. In the same manner as in Example 25, the kneaded mixture is formed into a pressure-sensitive copy sheet and is used to form a layer of the blue color-forming composition on the back surface of an original in the same manner as in Example 25.

EXAMPLE 27

Linseed oil is added to the color-forming composition of Example 19, and the mixture is formed into a pressure-sensitive copy sheet in the same manner as in Example 25. This pressure-sensitive copy sheet is used to form a layer of the yellow color-forming composition on the back surface of an original in the same manner as in Example 25.

EXAMPLE 28

20 g of flax oil is added to the color-forming composition of Example 22, and in the same manner as in Example 10 the mixture is formed into a pressure-sensitive copy sheet. This copy sheet is used to form a layer of the brown color-forming composition on the back surface of an original in the same manner as in Example 25.

EXAMPLE 29

Multicolor-Forming Diazo-Type Photosensitive Paper for Wet Development 10 g of a double salt of 4-diazo-2,5-diethoxybenzoylaniline chloride.1/2 $ZnCl_2$, 8 g of citric acid, 0.1 g of Patent Blue and 10 g of Patent Blue and 10 g of dextrin are successivly dissolved in water, to make 1 liter of a solution. The solution is coated on a base paper by means of an air knife coater and dried to obtain a diazo-type photosensitive sheet for wet development.

The photosensitive paper is placed over the back surface of an original, a portion of which has been treated with the color-forming agent of Example 1 and another portion of which has been treated with the color-forming agent of Example 6. Then, the assembly is exposed to heat and light by means of a mercury lamp and developed using a liquid developer of the following recipe:

| | |
|---|---|
| NW acid (1-hydroxynaphthalene-4-sulfonic acid) | 20 g |
| Potassium carbonate | 20 g |
| Sodium thiosulfate | 40 g |
| Sodium bicarbonate | 30 g |
| Activating agent (non-ionic surfactant) | 1 g |
| Water | balance |
| Total | 1 liter |

Thus, there is obtained a clear multicolor copy in which image areas corresponding to the image areas of the original treated with the color-forming agent of Example 1 are colored reddish orange, image areas corresponding to the image areas of the original treated with the color-forming agent of Example 6 are colored yellow and remaining image areas corresponding to the non-treated image areas of the original are colored bluish violet.

EXAMPLE 30

Multicolor-Forming Diazo-Type Photosensitive Paper for Dry Development

A solution of the following recipe is prepared:

| | |
|---|---|
| 4-Diazo-N-ethyl-N-β-hydroxyethylamiline chloride.½$ZnCl_2$ | 10 g |
| Diethylene glycol | 50 g |
| Citric acid | 20 g |
| Bis-[5-hydroxy-7-sulfonaphthyl(2)]amine | 15 g |

-continued

| | |
|---|---|
| Zinc chloride | 40 g |
| Thiourea | 30 g |
| Patent Blue | 0.1 g |
| Water | balance |
| Total | 1 liter |

The solution is coated on a base paper by a customary coating procedure such as using an air knife coater and dried to form a photosensitive sheet.

The sheet is placed over the back surface of an original, a portion of which has been treated with the color-forming agent of Example 1, another portion of which has been treated with the color-forming agent of Example 6 and still another portion of which has been treated with the color-forming agent of Example 8. Then, the assembly is exposed to light and heat by means of a mercury lamp to form a latent image of the diazonium salt.

Next, the exposed sheet is developed with gaseous ammonia and steam. Thus, there is obtained a clear multicolor copy in which image areas corresponding to the image areas of the original treated with the color-forming agent of Example 1 are colored red, image areas corresponding to the image areas of the original treated with the color-forming agent of Example 6 are colored yellow, image areas corresponding to the image areas of the original treated with the color-forming agent of Example 8 are colored brown, and the remaining image areas corresponding to the non-treated image areas of the original are colored dark blue.

EXAMPLE 31

Multicolor-Forming Diazo-Type Photosensitive Paper for Dry Development

A solution of the following recipe is prepared:

| | |
|---|---|
| 4-Diazo-N,N-dimethylaniline chloride.½$ZnCl_2$ | 20 g |
| Diethylene glycol | 50 g |
| Tartaric acid | 20 g |
| Sodium 2,7-dihydroxynaphthalene-3,6-disulfonate | 15 g |
| Resorcin monomethyl ether | 10 g |
| Zinc chloride | 10 g |
| Thiourea | 50 g |
| Sodium 1,3,6-naphthalene-trisulfonate | 20 g |
| Patent Blue | 0.1 g |
| Water | balance |
| Total | 1 liter |

The solution is coated on a base paper by a customary coating procedure such as using an air knife coater and dried to form a photosensitive sheet.

The sheet is placed over the back surface of an original, a portion of which has been treated with the color-forming agent of Example 1, another portion of which has been treated with the color-forming agent of Example 3 and still another portion of which has been treated with the color-forming agent of Example 6. The assembly is heated (70° – 90°C.) and exposed to light by means of a mercury lamp.

Next, the exposed sheet is developed with gaseous ammonia and steam. Thus, there is obtained a clear multicolor copy with a good hue separation, in which image areas of the original treated with the color-forming agent of Example 1 are colored red, image areas corresponding to the image areas of the original treated with the color-forming agent of Example 3 are colored blue, image areas corresponding to the image areas of the original treated with the color-forming agent of Example 6 are colored yellow, and the remaining image areas corresponding to the non-treated image areas of the original are colored black.

EXAMPLE 32

Photosensitive Paper for either Wet or Dry Development

A solution of the following recipe is prepared:

| | |
|---|---|
| 4-Diazo-2,5-dibutoxy-N-phenylmorpholine.½ $ZnCl_2$ | 15 g |
| Ethylene glycol | 50 g |
| β-hydroxynaphthoic acid γ-morpholinopropylamide | 8 g |
| Tartaric acid | 23 g |
| Thiourea | 30 g |
| Zinc | 20 g |
| Sodium 1,3,6-naphthalenesulfonate | 20 g |
| Patent Blue | 0.1 g |
| Water | balance |
| Total | 1 liter |

The solution is coated on a base paper by a customary coating procedure such as using an air knife coater and dried to form a photosensitive sheet for either wet or dry development.

The sheet is placed over the back surface of an original comprising image areas covered with the pressure-sensitive sheet of Example 10 and formed by pressing or writing, another image areas covered with the pressure-sensitive sheet of Example 12 and formed by pressing or writing, and still another image areas covered with the pressure-sensitive sheet of Example 13. The assembly is exposed to light and heated (about 120°C.) by a mercury lamp, to thereby form a latent image of the diazonium salt and effect the heat transfer of the couplers from the color-forming agent layers to the photosensitive layer. The exposed sheet is then developed with gaseous ammonia and steam or an alkaline liquid developer of the following recipe:

| | |
|---|---|
| Diethanolamine | 150 g |
| Sodium benzoate | 200 g |
| Potassium carbonate | 15 g |
| Potassium tetraborate | 30 g |

Thus, there is obtained a clear 4-color copy in which image areas corresponding to the image areas of the original treated with the agent of Example 10 are colored redish orange, image areas corresponding to the image areas of the original treated with the agent of Example 12 are colored yellow, image areas corresponding to the image areas of the original treated with the agent of Example 13 are colored brown, and the remaining image areas corresponding to the non-treated image areas of the original are colored blue.

EXAMPLE 33

Procedures of Example 29 are repeated by employing an original, a portion of the back surface of which has been treated with the solid color-forming agent of Example 14 and another portion of the back surface of which has been treated with the solid color-forming agent of Example 19. Thus, there is obtained a clear multicolor copy in which image areas corresponding to the image areas of the original treated with the color-forming agent of Example 14 are colored reddish orange, image areas corresponding to the image areas of the original treated with the color-forming agent of Example 19 are colored yellow, and the remaining image areas corresponding to the non-treated image areas of the original are colored bluish violet.

EXAMPLE 34

Procedures of Example 31 are repeated by employing an original, a portion of the back surface of which has been treated with the solid color-forming agent of Example 14, another portion of the back surface of which has been treated with the color-forming agent of Example 16, and still another portion of the back surface of which has been treated with the color-forming agent of Example 18. Thus, there is obtained a clear multicolor copy with a good hue separation in which image areas corresponding to the image areas of the original treated with the color-forming agent of Example 14 are colored red, image areas corresponding to the image areas of the original treated with the color-forming agent of Example 16 are colored blue, image areas corresponding to the image areas of the original treated with the color-forming agent of Example 18 are colored violet, and the remaining image areas corresponding to the non-treated image areas of the original are colored black.

EXAMPLE 35

Procedures of Example 32 are repeated by employing an original, a portion of the back surface of which has been treated with the pressure-sensitive sheet of Example 25, another portion of the back surface of which has been treated with the pressure-sensitive sheet of Example 27 and still another portion of the back surface of which has been treated with the pressure-sensitive sheet of Example 28. Thus, there is obtained a clear 4-color copy in which image areas corresponding to the image areas of the original treated with the agent of Example 25 are colored reddish orange, image areas corresponding to the image areas of the original treated with the agent of Example 27 are colored yellow, image areas corresponding to the image areas of the original treated with the agent of Example 28 are colored brown, and the remaining image areas corresponding to the non-treated image areas of the original are colored blue.

EXAMPLE 36

In order to clearly indicate that the diazo-type color-forming compositions of this invention comprising a thermo-volatile or sublimable coupler and a polyalkylene oxide or its derivative which is solid under normal conditions have improved properties over the conventional color-forming compositions, the following comparative experiments were conducted.

1. Copy Number Test

Test Method:

Diazo-type color-forming compositions having the following recipe were prepared, and they were molten under heating, solidified are molded into crayons to be used as an agent for treating the surface, to be faced to a diazo-type photosensitive layer, of an original in an area to be reproduced in a different hue. Recipes of Color-Forming Compositions:

| | |
|---|---|
| I. Color-Forming Compositions of This Invention: | |
| A. Red color-forming composition (color-forming agent 1): | |
| 1-Phenyl-3-methylpyrazolone(5) | 35 g |
| Polyethylene glycol No. 10000 | 10 g |
| Hi-Filler (talc manufactured by Matsumura Sangyo K.K.) | 40 g |
| Stearic acid | 10 g |
| Paraffin wax | 5 g |
| B. Blue color-forming composition (color-forming agent 2): | |
| 2,3-Dihydroxynaphthalene | 35 g |
| Polyethylene glycol No. 10000 | 10 g |
| Hi-Filler (talc manufactured by Matsumura Sangyo K.K.) | 40 g |
| Stearic acid amide | 10 g |
| Paraffin wax | 5 g |
| C. Yellow color-forming composition (color-forming agent 3): | |
| Acetoacetic anilide | 35 g |
| Polyethylene glycol No. 10000 | 10 g |
| Hi-Filler (talc manufactured by Matsumura Sangyo K.K.) | 40 g |
| Palm wax | 10 g |
| Microcrystalline wax | 5 g |
| D. Brown color-forming composition (color-forming agent 4): | |
| β-Naphthol | 35 g |
| Polyethylene glycol No. 10000 | 10 g |
| Ethylene-bis-stearic acid amide | 10 g |
| Hi-Filler (talc manufactured by Matsumura Sangyo K.K.) | 40 g |
| Paraffin wax | 5 g |
| II. Conventional Color-Forming Compositions: | |
| A'. Red color-forming composition (color-forming agent 5): | |
| 1-Phenyl-3-methylpyrazolone (5) | 35 g |
| Hi-Filler (talc manufactured by Matsumura Sangyo K.K.) | 40 g |
| Stearic acid | 10 g |
| Paraffin wax | 10 g |
| Ethyl cellulose | 5 g |
| B'. Blue color-forming composition (color-forming agent 6): | |
| 2,3-Dihydroxynaphthalene | 35 g |
| Hi-Filler (talc manufactured by Matsumura Sangyo K.K.) | 40 g |
| Stearic acid | 10 g |
| Paraffin wax | 10 g |
| Carboxymethyl cellulose | 5 g |
| C'. yellow color-forming composition (color-forming agent 7): | |
| Acetoacetic anilide | 35 g |
| Hi-Filler (talc manufactured by Matsumura Sangyo K.K.) | 40 g |
| Palm wax | 10 g |
| Microcrystalline wax | 10 g |
| Ethyl cellulose | 5 g |
| D'. Brown color-forming composition (color-forming agent 8): | |
| β-Naphthol | 35 g |
| Hi-Filler (talc manufactured by Matsumura Sangyo K.K.) | 40 g |
| Ethylene-bis-stearic acid | 10 g |
| Paraffin wax | 10 g |
| Methyl cellulose | 5 g |

An original sheet consisting of tracing paper (SZ-70 manufactured by Tomoegawa Seishi K. K.) having several black images thereon was treated with the so formed crayon-like color-forming agents in preselected image areas on the surface to be brought into face-to-face contact with a diazo-type photosensitive layer. Thus, there was obtained an original for multicolor reproduction.

Separately, a base paper, which had been coated with an aqueous dispersion containing 30 % of an acrylic resin emulsion (Mowinyl 710 manufactured by Hoechst A. G.) and 20 % of a styrene-acrylonitrile copolymer resin emulsion (Mowinyl L-710 manufactured by Hoechst A. G.) and then dried, was coated with a photosensitive liquid of the following recipe by means of an air knife coater so that the amount coated was about 3 g/m$^2$ on the dry basis and dried to obtain a photosensitive sheet for diazo-type multi-color reproduction.

| | |
|---|---|
| 4-Diazo-N-ethyl-N-β-ethylbenzoyloxy-aniline chloride.½ $ZnCl_2$ | 20 g |
| Tartaric acid | 80 g |
| Methyl glycol | 50 g |

-continued

| | |
|---|---|
| Thiourea | 50 g |
| 2,3-Dihydroxynaphthalene-6-sulfonic acid | 2 g |
| 2,4,2',4'-tetrahydroxydiphenyl sulfide | 0.7 g |
| Snowtex (20 % $SiO_2$) | 300 g |
| Polyvinyl acetate emulsion (Mowinyl DC manufactured by Hoechst A. G.) | 50 g |
| Patent Blue | 0.1 g |
| Water | balance |
| Total | 1 liter |

The so obtained photosensitive sheet was placed on the above original for multicolor reproduction so that the photosensitive layer was brought into face-to-face contact with the color-forming agent-treated surface of the original. The assembly was exposed to light and heated (105°C.) by means of a copying machine installed with a mercury lamp and an infrared radiation heater (Dina-Miracle 3000 manufactured by Mita Kogyo K. K.) to form a latent image of the diazonium salt and effect the heat transfer of the couplers from the color-forming agent layers to the photosensitive layer. Then, the exposed sheet was developed with a gaseous mixture of ammonia and steam. Thus, there was obtained a multicolor copy in which image areas corresponding to the image areas of the original treated with the color-forming agents were colored in respective hues, and the remaining image areas corresponding to the non-treated image areas of the original were colored grey. The above operations of light exposure, heating and development were repeated using the same originals. Thus, 20 copies were prepared per original. In respect to each of the so obtained copies and each color, L, a and b values in the u.c.s. unit were measured according to the method specified by JIS Z-8722 with use of a color-difference meter (Model CS-4A manufactured by Nippon Denshoku K. K.), and the color difference between the basic gray color in the image areas corresponding to the non-treated image areas of the original and each of colors formed in respective pre-selected areas was calculated according to the following known formula, to obtain results shown in Table 1.

Color Difference, $\Delta E = \sqrt{(\Delta L)^2 + (\Delta a)^2 + (\Delta b)^2}$ the hue separation was hardly attained, when the Δ E value was lower than about 20 in the case of the red color, lower than 18 in the case of the blue color, lower than 25 in the case of the yellow color and lower than 20 in the case of the brown color.

From the results shown in Table 1, it is apparent that the color-forming compositions of this invention including a polyalkylene oxide or its derivative as the hue separation-improving agent are much superior to the conventional color-forming compositions in respect to adherence and retention to an original, and that when the color-forming compositions of this invention are employed, the number of copies obtainable from one treated original can be highly increased.

For example, in respect to the red color, the number of copies with good hue separation is only about 14 in the case of the conventional composition, whereas more than 20 copies (up to about 30 copies) can be obtained with good hue separation in the case of the color-forming composition of this invention. Further, in respect to the blue color, up to the 20th copy the color difference is hardly changed and about 35 copies can be obtained with good hue separation in the case of the color-forming composition of this invention, whereas the number of copies with good fue separation is only 15 or 16 in the case of the conventional color-forming composition. Furthermore, in respect to the yellow color, a good hue separation is attained in up to the 20th copy in the case of the composition of this invention, while the number of copies with good hue separation is only about 7 in the case of the conventional composition, and in respect to the brown color, about 20 copies can be obtained with good hue separation in the case of the composition of this invention, while the number of copies with good hue separation is only about 3 in the case of the conventional composition.

2. Adhesion Test

In order to clearly indicate that the color-forming composition of this invention is excellent in adherence and retention on various originals and since it is tightly retained on the original surface during the copying operation, the copying efficiency is not reduced at all, Table 1

| Ordinal Number of Copy | Color-Forming Agent Invention | | | | Conventional Color-Forming Agent | | | |
|---|---|---|---|---|---|---|---|---|
| | 1 (red) | 2 (blue) | 3 (yellow) | 4 (brown) | 5 (red) | 6 (blue) | 7 (yellow) | 8 (brown) |
| 1 | 44.2 | 30.5 | 38.6 | 27.8 | 43.9 | 28.4 | 34.8 | 25.3 |
| 2 | 43.7 | 31.2 | 38.0 | 26.1 | 40.2 | 29.0 | 32.7 | 23.0 |
| 3 | 44.0 | 30.5 | 37.3 | 25.9 | 41.3 | 27.7 | 30.6 | 19.1 |
| 4 | 43.5 | 30.3 | 38.1 | 26.4 | 39.1 | 26.5 | 29.0 | 16.6 |
| 5 | 42.9 | 29.2 | 37.9 | 25.3 | 37.4 | 25.3 | 29.0 | 14.4 |
| 6 | 42.5 | 30.4 | 37.2 | 25.8 | 26.3 | 25.3 | 28.6 | 13.9 |
| 7 | 42.8 | 29.0 | 36.8 | 24.7 | 27.4 | 23.2 | 25.1 | 13.5 |
| 8 | 41.2 | 28.4 | 37.1 | 24.1 | 25.5 | 21.8 | 23.6 | 11.2 |
| 9 | 40.0 | 28.8 | 36.0 | 23.0 | 24.9 | 22.2 | 20.4 | 10.8 |
| 10 | 40.8 | 28.3 | 36.4 | 23.7 | 25.4 | 20.9 | 19.5 | 10.3 |
| 11 | 39.9 | 28.6 | 36.9 | 22.9 | 23.7 | 21.1 | 20.6 | 7.3 |
| 12 | 40.3 | 28.5 | 35.8 | 23.1 | 23.5 | 19.5 | 17.1 | 8.0 |
| 13 | 39.5 | 28.2 | 36.0 | 22.4 | 21.2 | 19.8 | 13.4 | 6.5 |
| 14 | 39.1 | 27.5 | 35.1 | 21.8 | 19.9 | 19.8 | 14.2 | 5.9 |
| 15 | 39.0 | 27.0 | 34.5 | 22.5 | 19.8 | 19.3 | 10.3 | 5.5 |
| 16 | 39.4 | 27.8 | 34.1 | 20.6 | 16.3 | 18.2 | 8.9 | 4.2 |
| 17 | 38.3 | 27.3 | 34.0 | 21.2 | 15.9 | 17.4 | 9.1 | 3.9 |
| 18 | 37.5 | 26.9 | 33.7 | 21.3 | 13.2 | 16.9 | 8.6 | 3.3 |
| 19 | 38.2 | 27.5 | 34.5 | 29.8 | 12.4 | 16.0 | 7.4 | 4.0 |
| 20 | 37.9 | 27.8 | 32.1 | 20.1 | 11.2 | 16.4 | 8.5 | 4.2 |

Note: each value being color difference, ΔE value, from the basic color (gray)

Incidentally, it was confirmed that distinction of the formed color from the basic color was difficult, namely the following test was conducted. Test Method:

Tracing paper (SZ-70 manufactured by Tomoegawa Seishi K. K.), Delumina SM-G (paper for diazo-type second original manufactured by Sanyo Pulp K. K.), mat finish polyester film and clear coat polyester film, each having image areas, were used as base papers. Color-forming agent layers were formed on the surface, to be faced to a photosensitive layer, of each base paper, with use of the color-forming compositions described in the above copy number test (1). The so formed originals for diazo-type color reproduction and photosensitive sheets prepared in the same manner as in the test (1) were light-exposed, heated and developed under the same conditions as in the test (1), and the number of copies in which good hue separation was counted to obtain results shown in Table 2.

Table 2

| Hues of Agent | Recipe | Tracing Paper | Delmina SM-G | Mat Finis Polyester Film | Clear Coat Polyester Film |
|---|---|---|---|---|---|
| Compositions of This Invention | | | | | |
| red | A | 28 | 21 | 29 | 15 |
| blue | B | 35 | 27 | 39 | 23 |
| yellow | C | 25 | 19 | 27 | 14 |
| brown | D | 30 | 34 | 35 | 17 |
| Conventional Compositions | | | | | |
| red | A' | 11 | 3 | 14 | 2 |
| blue | B' | 15 | 9 | 17 | 3 |
| yellow | C' | 7 | 4 | 10 | 2 |
| brown | D' | 4 | 3 | 5 | 2 |

Note: each number indicates the number of copies obtained with good hue separation From the results shown in Table 2, it will readily be understood that the color-forming compositions of this invention incorporated with a polyalkylene oxide or its derivative are excellent over the conventional color-forming compositions with respect to the adhesion or retention on various originals and their color-forming characteristics are highly improved. For example, about 30 copies can be obtained from a tracing paper treated with the color-forming agent of this invention, whereas only about 10 copies are obtained from a tracing paper original treated with the conventional color-forming agent. Further, in the case of a mat finish polyester film original, similar improvement of the color-forming characteristics can be attained in the color-forming composition of this invention. Furthermore, even in the case of a clear coat polyester film original from which only 2 or 3 are obtained when the conventional color-forming agents are employed, it is possible to obtain a much larger number of copies with use of the color-forming composition of this invention, namely 14 copies in the case of the yellow color-forming agent, 15 copies in the case of the red color-forming agent, 17 copies in the case of the brown color-forming agent and 23 copies in the case of the blue color-forming agent. Accordingly, it is apparent that the color forming composition of this invention can be retained on any of originals regardless of the color-forming agent-retaining property of the original.

3. Test for Determination of Compatibility with Coupler

In order to clearly indicate that when a polyalkylene oxide or its derivative is used as the hue separation-improving agent according to this invention, it hardly has a reactivity with a thermo-volatile or sublimable coupler as compared with conventional molding assistants, such as ethyl cellulose, acetal resins, vinylidene chloride resins, styrene resins and other macromolecular compounds and the color-forming properties of the resulting color-forming composition can be highly improved without deterioration or discoloration, the following test was conducted. Test Method:

Color-forming composition having the following recipe were prepared, molten under heating, solidified and molded into crayons, and the molding state and the deterioration or discoloration of the molded crayons were examined with the naked eye. Further, with use of the so molded treating agents, the copy number test was conducted in the same manner as in the test (1) above, and the number of copies with good hue separation obtainable from one treated original was examined to evaluate the effect of improving the color-forming characteristics by the hue separation-improving agent of this invention. Recipes of Color-Forming Compositions: Compositions of This Inventions:

| | | |
|---|---|---|
| a. | Yellowish Brown Color-Forming Agent: | |
| | Resorcin | 35 g |
| | Polyethylene glycol No. 10000 | 10 g |
| | Hi-Filler (talc manufactured by Matsumura Sangyo K.K.) | 40 g |
| | Stearic acid | 10 g |
| | Paraffin wax | 5 g |

b. Brown Color-Forming Agent:

In the composition (a), resorcin was replaced by $\beta$-naphthol.

c. Blue Color-Forming Agent:

In the composition (a), 2,3-dihydroxynaphthalene was used instead of resorcin.

d. Yellow Color-Forming Agent:

In the composition (a), resorcin was replaced by acetoacetic anilide.

e. Red Color-Forming Agent:

In the composition (a), 1-phenyl-3-methylpyrazolone(5) was used instead of resorcin. Conventional Compositions:

Conventional color-forming agents (*a*)–1, (*b*)-1, (*c*)-1, (*d*)-1 and (*e*)-1 were formed by using ethyl cellulose instead of polyethylene glycol No. 6000 in the above color-forming agents (*a*), (*b*), (*c*), (*d*) and (*e*), respectively.

Further, conventional color-forming agents (*a*)-2, (*b*)-2, (*c*)-2, (*d*)-2 and (*e*)-2, (*a*)-3, (*b*)-3, (*c*)-3, (*d*)-3 and (*e*)-3, and (*a*)-4, (*b*)-4, (*c*)-4, (*d*)-4 and (*e*)-4 by employing an acetal resin, a vinylidene chloride resin and a styrene resin, respectively, instead of ethylcellulose in the conventional color-forming agents (*a*)-1 to (*e*)-1.

Test results obtained are shown in Table 3.

Table 3

| Molding Assistant | Color-Forming Agent | Heat-Transferable Coupler | Color | Molding State | Number of Copies | Reactivity between coupler and Molding Assistant | Discoloration of Change of State |
|---|---|---|---|---|---|---|---|
| Color-Forming Compositions of This Invention | | | | | | | |
| PEG | (a) | resorcin | yellowish brown | good | 23 | not observed | not observed |
| PEG | (b) | β-naphthol | brown | good | 31 | not observed | not observed |
| PEG | (c) | 2,3-dihydroxynaphthalene | bluish violet | good | 35 | not observed | not observed |
| PEG | (d) | acetoacetic anilide | yellow | good | 26 | not observed | not observed |
| PEG | (e) | 1-phenyl-3-methylpyrazolone | red | good | 28 | not observed | not observed |
| Conventional Color-Forming Compositions | | | | | | | |
| EC | (a)-1 | resorcin | yellowish brown | bad because of viscosity increase | 5 | observed | viscosity increase |
| EC | (b)-1 | β-naphthol | brown | bad because of viscosity increase | 6 | observed | viscosity increase |
| EC | (c)-1 | 2,3-dihydroxynaphthalene | bluish violet | bad because of viscosity increase | 13 | observed | viscosity increase |
| EC | (d)-1 | acetoacetic anilide | yellow | discolored after standing still | 7 | observed | yellowing |
| EC | (e)-1 | 1-phenyl-3-methylpyrazolone | red | discolored after standing still | 10 | observed | yellowing |
| AC | (a)-2 | resorcin | yellowish brown | bad because of viscosity increase | 4 | observed | viscosity increase |
| AC | (b)-2 | β-naphthol | brown | bad because of viscosity increase | 5 | observed | viscosity increase |
| AC | (c)-2 | 2,3-dihydroxynaphthalene | bluish violet | bad because of viscosity increase | 12 | observed | viscosity increase |
| AC | (d)-2 | acetoacetic anilide | yellow | discolored after standing still | 5 | observed | yellowing |
| AC | (e)-2 | 1-phenyl-3-methylpyrazolone | red | discolored after standing still | 9 | observed | yellowing |
| VC | (a)-3 | resorcin | yellowish brown | bad because of viscosity increase | 6 | observed | viscosity increase |
| VC | (b)-3 | β-naphthol | brown | bad because of viscosity increase | 6 | observed | viscosity increase |
| VC | (b)-3 | 2,3-dihydroxynaphthalene | bluish violet | bad because of viscosity increase | 12 | observed | viscosity increase |
| VC | (d)-3 | acetoacetic anilide | yellow | discolored after standing still | 5 | observed | yellowing |
| VC | (e)-3 | 1-naphthyl-3-methylpyrazolone | red | discolored after standing still | 11 | observed | yellowing |
| St | (a)-4 | resorcin | yellowish brown | bad because of viscosity increase | 5 | observed | viscosity increase |
| St | (b)-4 | β-naphthol | brown | bad because of viscosity increase | 6 | observed | viscosity increase |
| St | (c)-4 | 2,3-dihydroxynaphthalene | bluish violet | bad because of viscosity increase | 14 | observed | viscosity increase |
| St | (d)-4 | acetoacetic anilide | yellow | discolored after standing still | 5 | observed | yellowing |
| St | (e)-4 | 1-phenyl-3-methylpyrazolone | red | discolored after standing still | 10 | observed | yellowing |

Note: PEG=polyethylene glycol,
EC=ethyl cellulose,
AC=acetal resin,
VC=vinylidene chloride resin,
St=styrene resin From the results shown in Table 3, it will readily be understood that the color-forming compositions of this invention incorporated with a polyalkylene oxide or its derivative as the hue separation-improving agent which acts also as the molding assistant have excellent moldability and color-forming properties over conventional color-forming compositions including a known molding assistant such as ethyl cellulose, acetal resins, vinylidene chloride resins and the like. For example, the known molding assistants have a reactivity with heat-transferable couplers of the hydroxybenzene or hydroxynaphthalene type, and therefore, the viscosity increase occurs during the step of molding color-forming agents. Accordingly, a good molding state cannot be attained and deterioration of heat-transferable couplers is brought about, resulting in reduction of the heat transferability. In the case of active methylene group-containing couplers, when mixtures of the conventional molding assistants and couplers are allowed to stand still, discoloration is caused to occur, resulting in bad influences on resulting copies.

In contrast, in the case of the hue separation-improving agent of this invention, no reactivity is observed with any of couplers, and hence, such undesired phenomena as deterioration and discoloration are not brought about. Further, in the case of the hue separation-improving agent of this invention, molding can be conducted in good conditions and the color-forming property is highly improved. For example, more than 20 copies can be obtained with good hue separation from one original treated with the color-forming composition of this invention, whereas as only 10 or less than 10 copies are obtainable from one original treated with the conventional color- forming composition. Thus, it will readily be understood that the polyalkylene oxide or its derivative of this invention can be applied to any of couplers and improves the color-forming characteristics of any coupler.

EXAMPLE 37

The copy number test mentioned in Example 36 was conducted in the same manner with respect to color-forming compositions of this invention including a fatty acid derivative having a melting point of at least 100 and conventional color-forming compositions free of such hue separation-improving agent.

Compositions tested are as follows:

| | | |
|---|---|---|
| Color-Forming Compositions of This Invention: | | |
| A. | Red Color-Forming Agent 1: | |
| | 1-Phenyl-3-methylpyrazolone(5) | 50 g |
| | Palmitic acid amide | 30 g |
| | Paraffin wax (melting point = 83°C.) | 15 g |
| | $SiO_2$ (powdery silica) | 5 g |
| B. | Blue Color-Forming Agent 2: | |
| | 2,3-Dihydroxynaphthalene | 50 g |
| | Stearic acid amide | 30 g |
| | Activated clay | 10 g |
| | Paraffin wax (melting point = 83°C.) | 10 g |
| C. | Yellow Color-Forming Agent 3: | |
| | Acetoacetic anilide | 50 g |
| | Palmitic acid bromoanilide | 15 g |
| | Sodium stearate | 15 g |
| | Palm wax | 10 g |
| | Olefin wax (melting point = 83°C.) | 5 g |
| | $SiO_2$ (powdery silica) | 5 g |
| D. | Brown Color-Forming Agent 4: | |
| | β-Naphthol | 50 g |
| | Ethylene-bis-stearic acid amide | 30 g |
| | Polyethylene glycol No. 6000 | 10 g |
| | Paraffin wax (melting point = 83°C.) | 5 g |
| | Zinc oxide | 5 g |
| Conventional Color-Forming Compositions: | | |
| A'. | Red Color-Forming Agent 5: | |
| | 1-Phenyl-3-methyl-pyrazolone(5) | 50 g |
| | Palmitic acid | 30 g |
| | Paraffin wax | 15 g |
| | $SiO_2$ (powdery silica) | 5 g |
| B'. | Blue Color-Forming Agent 6: | |
| | 2,3-Dihydroxynaphthalene | 50 g |
| | Stearic acid | 30 g |
| | Activated clay | 10 g |
| | Paraffin wax | 10 g |
| C'. | Yellow Color-Forming Agent 7: | |
| | Acetoacetic anilide | 50 g |
| | Palmitic acid | 15 g |
| | Stearic acid | 15 g |
| | Palm wax | 10 g |
| | Olefin wax | 5 g |
| | $SiO_2$ (powdery silica) | 5 g |
| D'. | Brown Color-Forming Agent 8: | |
| | β-Naphthol | 50 g |
| | Ethyl cellulose | 10 g |
| | Paraffin wax | 5 g |
| | Zinc oxide | 5 g |

Test results obtained are shown in Table 4.

Table 4

| Ordinal Number of Copy | Color-Forming Agent Invention | | | | Conventional Color-Forming Agent | | | |
|---|---|---|---|---|---|---|---|---|
| | 1 (red) | 2 (blue) | 3 (yellow) | 4 (brown) | 5 (red) | 6 (blue) | 7 (yellow) | 8 (brown) |
| 1 | 43.2 | 29.6 | 37.5 | 26.5 | 43.7 | 28.4 | 33.7 | 24.7 |
| 2 | 43.9 | 29.1 | 39.6 | 27.5 | 42.1 | 27.2 | 34.1 | 23.6 |
| 3 | 41.2 | 28.3 | 38.4 | 25.3 | 39.4 | 25.0 | 33.2 | 20.4 |
| 4 | 40.6 | 27.6 | 37.9 | 25.9 | 35.6 | 25.1 | 30.3 | 17.4 |
| 5 | 41.8 | 28.5 | 38.6 | 24.4 | 34.1 | 23.3 | 28.3 | 15.3 |
| 6 | 41.0 | 26.3 | 37.1 | 25.0 | 35.4 | 24.6 | 27.0 | 13.6 |
| 7 | 40.3 | 26.4 | 38.2 | 24.8 | 30.2 | 23.8 | 25.7 | 11.7 |
| 8 | 42,6 | 27.9 | 37.5 | 23.7 | 27.3 | 22.4 | 24.6 | 10.9 |
| 9 | 40.3 | 26.1 | 36.9 | 23.3 | 27.8 | 21.7 | 21.2 | 9.3 |
| 10 | 41.2 | 26.7 | 36.6 | 22.6 | 24.7 | 20.6 | 19.4 | 10.3 |
| 11 | 42.1 | 26.8 | 36.3 | 23.0 | 26.3 | 19.0 | 19.9 | 8.9 |
| 12 | 39.6 | 28.4 | 35.5 | 22.5 | 20.5 | 19.2 | 15.4 | 7.3 |
| 13 | 39.0 | 27.9 | 35.0 | 22.8 | 21.8 | 18.8 | 13.3 | 7.0 |
| 14 | 40.9 | 25.6 | 34.7 | 21.6 | 18.4 | 17.9 | 10.0 | 6.5 |
| 15 | 38.6 | 27.0 | 33.9 | 21.4 | 19.1 | 18.3 | 11.9 | 6.1 |
| 16 | 40.3 | 27.8 | 34.0 | 21.3 | 16.6 | 17.3 | 9.2 | 5.4 |
| 17 | 38.0 | 26.3 | 33.6 | 20.4 | 15.4 | 16.6 | 9.6 | 4.2 |
| 18 | 37.4 | 26.0 | 30.2 | 21.1 | 12.5 | 16.4 | 8.3 | 4.5 |
| 19 | 39.9 | 26.4 | 30.9 | 20.8 | 13.2 | 15.3 | 7.9 | 3.1 |
| 20 | 38.3 | 27.5 | 31.7 | 19.6 | 10.3 | 15.4 | 8.6 | 3.8 |

Note: each value being color difference, ΔE value, from the basic color (gray.)

Results shown in Table 4 as well as the results shown in Table 1 clearly indicate that when the hue separation-improving agent of this invention is incorporated into a color-forming composition for diazo-type multi-color reproduction, a large number of copies having a good hue separation can be obtained from one original treated with such color-forming composition.

What we claim is:

1. In a process for multi-color reproduction, which comprises:

A. exposing image-wise a diazo-type photosensitive material to actinic light by exposing through an original sheet of an assembly, said assembly consisting of (i) an original sheet having opaque image areas and transparent or semi-transparent non-image areas on one surface and a color-forming layer containing at least one thermovolatile or sublimable azo coupler (a), said layer being located in only preselected areas which are contiguous with opaque image areas of said original sheet, said preselected areas being present in only a portion of the areas contiguous with said opaque image areas of said original sheet, and (ii) a diazo-type photosensitive material having a photosensitive layer containing at least one photosensitive diazonium salt (c), an acidic stabilizer and an azo coupler (b) having a substantially lower rate of coupling with the diazonium salt (c) under the developing conditions than that of the azo coupler (a) said original sheet (i) being superimposed on said diazo-type photosensitive material (ii) so that the color-forming layer comes into face-to-face contact with the photosensitive layer;

B. heating said assembly to thereby heat-transfer said layer of the coupler (a) to the corresponding position on the surface of said photosensitive layer, said steps (A) and (B) being performed simultaneously or in the time sequence of (A) to (B) or (B) to (A); and C. contacting the exposed photosensitive material with a mixture of ammonia and steam or an alkali-containing aqueous liquid developer to thereby develop said photosensitive material, whereby in the unexposed latent image area of the portion to which the coupler (a) has been heat-transferred, a dye (c)–(a) having a certain hue or color is formed by the selective reaction of the heat-transferred coupler (a) with the diazonium salt (c) and at the same time, in the unexposed latent image areas to which the coupler (a) has not been heat-transferred, a dye (c)–(b) having a different hue or color from said dye (c)–(a) is formed by the reaction of the coupler (b) with the diazonium salt (c), thus producing a multi-colored copied image, the improvement wherein in addition to the thermo-volatile or sublimable coupler (a), the color-forming layer contains a hue separation-improving agent selected from the group consisting of a. polyalkylene oxides having recurring units represented by the following formula $$\text{-}(RO)_n\text{-}$$

wherein R is an alkylene group having 2 to 4 carbon atoms, and n is a number so selected that the polymer is solid under conditions of 20°C and one atmosphere pressure, b. carboxylic acid esters and ethers of polyalkylene oxide as described above, c. adducts between ethylene oxide or propylene oxide and stearic acid amide, lauric acid amide or oleic acid amide, and d. fatty acid amides other than said adducts, fatty acid imides, fatty acid aminoalkyl esters, fatty acid salts and condensates of fatty acid amide with formaldehyde, the melting point of which is 100°C or higher.

2. A process for multi-color reproduction, which comprises:

A. exposing image-wise a diazo-type photosensitive material to actinic light by exposing through an original sheet of an assembly, said assembly consisting of (i) an original sheet having opaque image areas and transparent or semi-transparent non-image areas on one surface and a color-forming layer containing at least one thermovolatile or sublimable azo coupler (a), said layer being located in only preselected areas which are contiguous with opaque image areas of said original sheet, said preselected areas being present in only a portion of the areas contiguous with said opaque image areas of said original sheet, and (ii) a diazo-type photosensitive material having a photosensitive layer containing at least one photosensitive diazonium salt (c), said original sheet (i) being superposed on said diazo-type photosensitive material (ii) so that the color-forming layer comes into face-to-face contact with the photosensitive layer;

B. heating said assembly to thereby heat-transfer said layer of the coupler (a) to the corresponding position on the surface of said photosensitive layer, said steps (A) and (B) being performed simultaneously or in the time sequence of (A) to (B) or (B) to (A); and C. thereafter developing the exposed photosensitive layer with an alkaline aqueous liquid developer containing a coupler (b), wherein said coupler (a) has a higher coupling rate under developing conditions than said coupler (b), whereby in the unexposed latent image area of the portion to which the coupler (a) has been heat-transferred, a dye (c)-(a) having a certain hue or color is formed by the selective reaction of the heat-transferred coupler (a) with the diazonium salt (c) and at the same time, in the unexposed latent image areas to which the coupler (a) has not been heat-transferred, a dye (c)–(b) having a different hue or color from said dye (c)–(a) is formed by the reaction of the coupler (b) with the diazonium salt (c), thus producing a multi-colored copied image, the improvement wherein in addition to the thermo-volatile or sublimable coupler (a), the color-forming layer contains a hue separation-improving agent selected from the group consisting of a. polyalkylene oxides having recurring units represented by the following formula $$\text{-}(RO)_n\text{-}$$

wherein R is an alkylene group having 2 to 4 carbon atoms, and n is a number so selected that the polymer is solid under conditions of 20°C. and one atmosphere pressure, b. carboxylic acid esters and ethers of polyalkylene oxide as described above, c. adducts between ethylene oxide or propylene oxide and stearic acid amide, lauric acid amide or oleic acid amide, and d. fatty acid amides other than said adducts, fatty acid imides, fatty acid aminoalkyl esters, fatty acid salts and condensates of fatty acid amide with formaldehyde condensates, the melting point of which is 100°C or higher.

3. The process according to claim 1 wherein the hue separation-improving agent is a polyalkylene oxide selected from the group consisting of polyethylene oxide, polypropylene oxide and polyethylene oxide-polypropylene oxide.

4. The process according to claim 1 wherein the polyalkylene oxide is a polyethylene oxide having a molecular weight of at least 3000.

5. The process according to claim 1 wherein the polyalkylene oxide derivative is an ester represented by the formula $R'COO(RO)_nH$ or $R'COO(RO)_nCOR'$ in which R stands for an alkylene group having 2 to 4 carbon atoms, n is a number larger than 1 and R′ designates a higher aliphatic hydrocarbon group.

6. The process according to claim 1 wherein the polyalkylene oxide derivative is an ether represented by the formula $R^2O(RO)_nH$ or $R^2O(RO)_nR^2$ in which R is an alkylene group having 2 to 4 carbon atoms, $n$ is a number larger than 1 and $R^2$ designates a hydrocarbon group having at least 6 carbon atoms.

7. The process according to claim 1 wherein the fatty acid derivative is a higher saturated fatty acid amide.

8. The process according to claim 1 wherein the fatty acid derivative is a higher fatty acid hydrazide.

9. The process according to claim 1 wherein the fatty acid derivative is a higher fatty acid p-hydroxyanilide.

10. The process according to claim 1 wherein the fatty acid derivative is a hydrochloride of a $\beta$-diethylaminoethyl ester of a higher fatty acid.

11. The process according to claim 1 wherein the fatty acid derivative is a metal soap having a melting point of at least 100°C.

12. The process according to claim 1 wherein the fatty acid derivative is a condensate of stearic acid amide or an amide of a fatty acid mixture containing stearic acid with formaldehyde.

13. The process according to claim 1 wherein the thermovolatile or sublimable coupler is selected from the group consisting of phenols, aminophenols, naphthols and active methylene groupcontaining compounds, each member being free of a carboxylic acid or sulfonic acid group.

14. The process according to claim 1 wherein the hue separationimproving agent is incorporated into the color-forming composition in an amount of 20 to 250 parts by weight per 100 parts by weight of the thermovolatile or sublimable coupler.

15. The process according to claim 1 wherein the heat transfer of the coupler is performed by heating the layer of the colorforming composition at a temperature of at least 50°C.

16. The process according to claim 1 wherein the color-forming composition consists of a solid mixture comprising 10 to 80 parts by weight of the thermovolatile or sublimable coupler, 5 to 70 parts by weight of the hue separation-improving agent, 0 to 60 parts by weight of a molding agent, 0 to 50 parts by weight of an extender pigment, 0 to 30 parts by weight of an extender and 0 to 2 parts by weight of a colorant.

17. The process of claim 16 wherein the molding agent is selected from the group consisting of mineral waxes, vegetable waxes, animal waxes, solid fatty acids, fats and solid alcohols.

* * * * *